United States Patent [19]

Horii et al.

[11] 4,428,117

[45] Jan. 31, 1984

[54] RECIPROCATING TYPE ELECTRIC SHAVER

[75] Inventors: Sadashige Horii; Hirozoh Imai; Tetsuo Hamashima, all of Kadoma, Japan

[73] Assignee: Matsushita Electric Works, Ltd., Osaka, Japan

[21] Appl. No.: 388,721

[22] Filed: Jun. 15, 1982

[30] Foreign Application Priority Data

Jun. 30, 1981 [JP] Japan ..... 56-97957

[51] Int. Cl.[3] ..... B26B 19/02

[52] U.S. Cl. ..... 30/43.91; 30/43.7; 30/43.8; 30/43.9

[58] Field of Search ..... 30/43.91, 43.7, 43.8, 30/43.9

[56] References Cited

U.S. PATENT DOCUMENTS

| | | | |
|---|---|---|---|
| 2,590,452 | 3/1952 | Peterson | 30/43.91 X |
| 3,903,597 | 9/1975 | Cobarg | 30/43.91 |
| 4,174,569 | 11/1979 | Schenk et al. | 30/43.7 X |

*Primary Examiner*—E. R. Kazenske
*Assistant Examiner*—William Fridie, Jr.
*Attorney, Agent, or Firm*—Burns, Doane, Swecker & Mathis

[57] ABSTRACT

A reciprocating type electric shaver comprises an inner-blade mount holding many inner blades and connected to a first driver-element converting rotary motion of a motor into reciprocating motions and an outer blade connected to a second driver-element reciprocated at a mechanical phase reverse to the first driver-element so that the inner blades and outer blade can slidably engage with each other mutually at mechanically reverse phase and the relative momentum of the outer blade with respect to the inner blades can be enlarged.

6 Claims, 7 Drawing Figures

Fig. 5
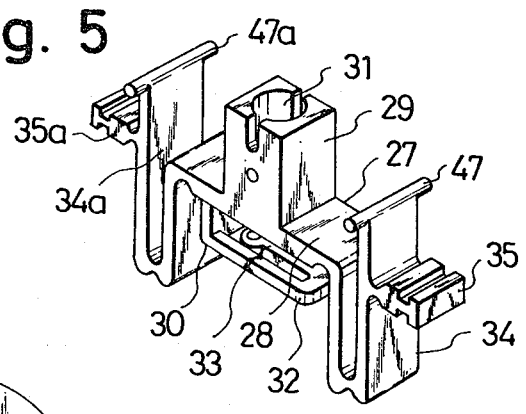
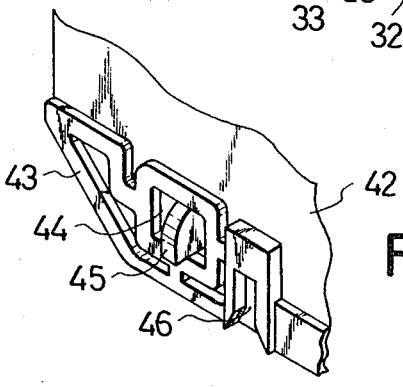
Fig. 6
Fig. 7
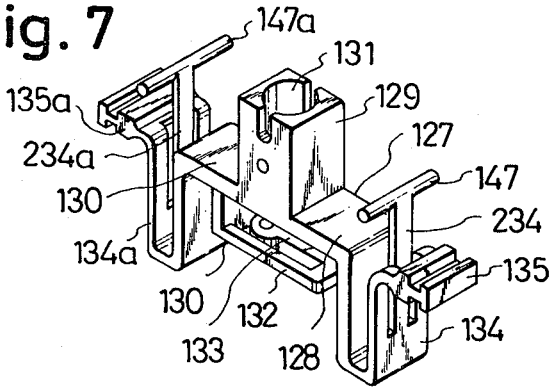

RECIPROCATING TYPE ELECTRIC SHAVER

This invention relates to reciprocating type electric shavers and, more particularly, to improvements in the reciprocating type electric shaver in which an outer blade is also displaced with respect to reciprocally driven inner blades.

Generally, in the reciprocating type electric shaver of the kind referred to, an inner blade assembly having many inner blades arranged mutually parallel and at right angles with respect to the moving direction of the assembly is reciprocated while sliding in contact with the inner surface of the outer blade and beard hair introduced into many hair introducing apertures made in the outer blade are shorn by the inner blade. In such case, beard hair positioned at their tip end to correspond to the hair introducing holes of the outer blade brought into contact with the user's face skin can be comparatively smoothly cut, but those positioned to correspond to ribs between the respective hair introducing apertures will hit at their tip end only the ribs and, in order to well shave them, displacements of the shaver along the face skin must be made several times so that the shaving has been rather time-consuming.

In order to solve this problem, there has been suggested a formation wherein the outer blade is vibrated so that the beard hair even initially contacting the ribs can be well introduced into the apertures. In U.S. Pat. No. 3,264,734, for example, there has been disclosed an arrangement wherein one of shearing blades is rotated while being slidably contacted with the other blade which itself is vibrated in one direction. In this arrangement, however, the amplitude of the vibration taken to be large will be likely to generate unpleasant noises and, on the other hand, the amplitude made small reduces the noises but the hair introducing efficiency cannot be well elevated.

A primary object of the present invention is, therefore, to provide a reciprocating type electric shaver wherein the required displacement of the shaver along the face skin can be minimized and the hair introducing efficiency can be improved to be very high. According to the present invention, the outer blade is driven to be displaced at a mechanical phase reverse to the moving direction of the inner blade assembly so that the relative displacement of the outer blade to the inner blades can be increased or, in other words, both of the outer and inner blades are driven at mechanical phases reverse to each other so that the displacing amplitude of the outer blade itself can be restricted to be minimum but its relative amplitude with respect to the inner blades can be increased. With this increase of the relative amplitude of the outer blade, chances of beard hair entering hair introducing apertures can be increased, the rate of contact of the inner blades with such hair can be increased and the rate of hair shearing can be increased, whereby of the hair shaving operation can be simplified and the required shaving time can be reduced.

Further, as the outer blade is driven to be displaced at the mechanical pahse reverse to the moving direction of the inner blade assembly, a mechanical balance can be obtained, any vibrations in the shaver can be reduced and noises can be prevented from being generated.

Another object of the present invention is to provide a reciprocating type electric shaver wherein, as the outer blade is directly driven together with the inner blade assembly by the same driving source, both can be perfectly operated at the mechanical phase reverse to each other with a compact formation without providing any separate sychronizing means.

Other objects and advantages of the present invention shall become apparent from the following description detailed with reference to preferred embodiments shown in accompanying drawings, in which:

FIG. 5 is a perspective view as magnified of a driver of the electric shaver shown in FIG. 1;

FIG. 6 is a fragmentary perspective view as magnified for showing an engaging formation of an outer blade frame with an outer blade of the electric shaver of FIG. 1; and FIG. 7 is a perspective view as magnified of another embodiment of the driver according to the present invention.

Figure 1:
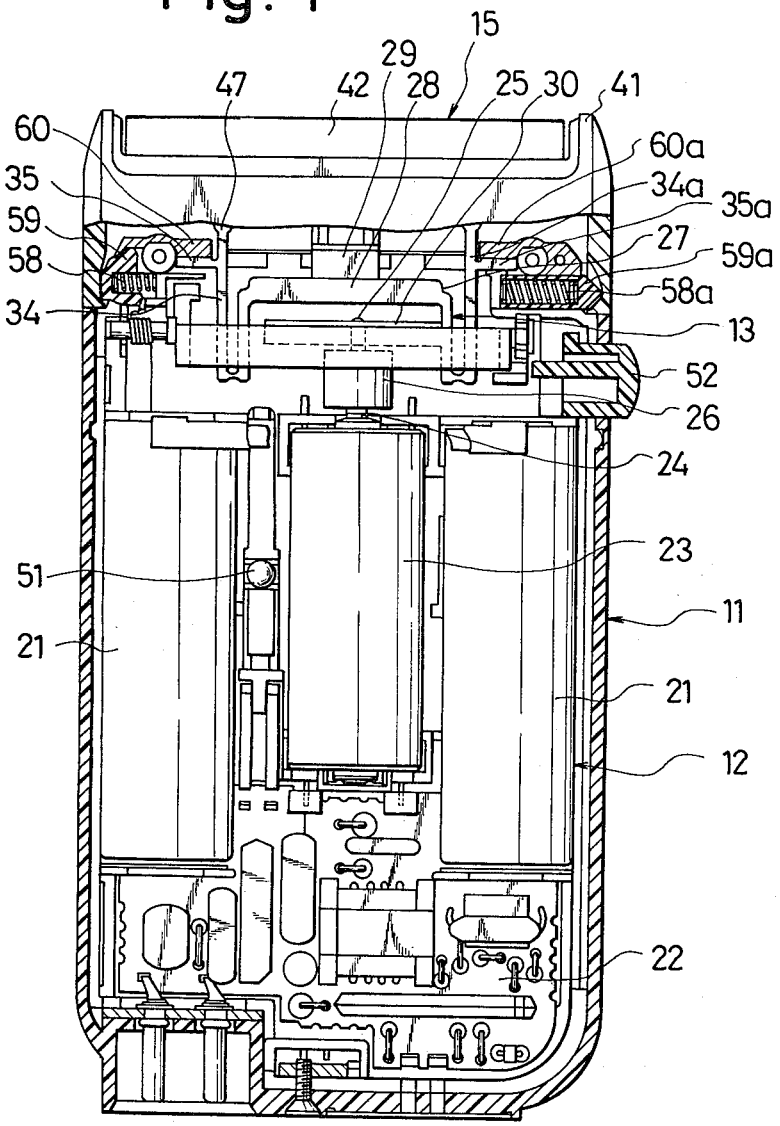
FIG. 1 is a vertically sectioned view of a reciprocating type electric shaver according to the present invention for showing the interior in detail.

While the present invention shall be explained in the followings with reference to the preferred embodiments shown in the accompanying drawings, it should be understood that the intention is not to limit the invention only to these embodiments but rather to include all modifications, alterations and equivalent arrangements possible within the scope of appended claims.

Referring now to FIGS. 1 to 4, the reciprocating type electric shaver comprises a casing 11 for all components such as follows, a driving source 12, a driving-force transmitting mechanism 13, an inner blade assembly 14 driven to be reciprocated by the transmitting mechanism 13, an outer blade assembly 15 within which the inner blade assembly 14 is provided to slidably engage at shearing edges of respective inner cutter blades with the inner surface of an outer blade of the assembly 15 which itself is driven to be reciprocated through the mechanism 13 by a later described driving formation, and such switching mechanism for controlling switching on and off of the driving source 12 as disclosed in, for example, U.S. patent application, Ser. No. 261,278 of Shirakawa et al. Preferably, or as required, a trimmer mechanism 16 is further provided in the casing 11 to be rotatable clockwise from the position shown in FIG. 2 and thus to be projected at trimming cutter edges out of the casing and connected at an inner end with the transmitting mechanism 13.

The driving source 12 includes batteries 21, a controlling circuit means 22 for controlling the output from the batteries 21 and a motor 23 to which electric power is fed from the batteries 21 when the switch mechanism is operated. On the other hand, the transmitting mechanism 13 includes a balancer 26 which is axially coupled at an end to an output shaft 24 of the motor 23 and having at the other end an eccentric pin 25 erected as deviated from the axis, and a driver 27 for converting the rotary motion of the motor 23 received through the eccentric pin 25 into reciprocating motions and preferably made of a synthetic resin so as to render, in the present instance, two driver-elements of different functions to be integral.

Figure 3:
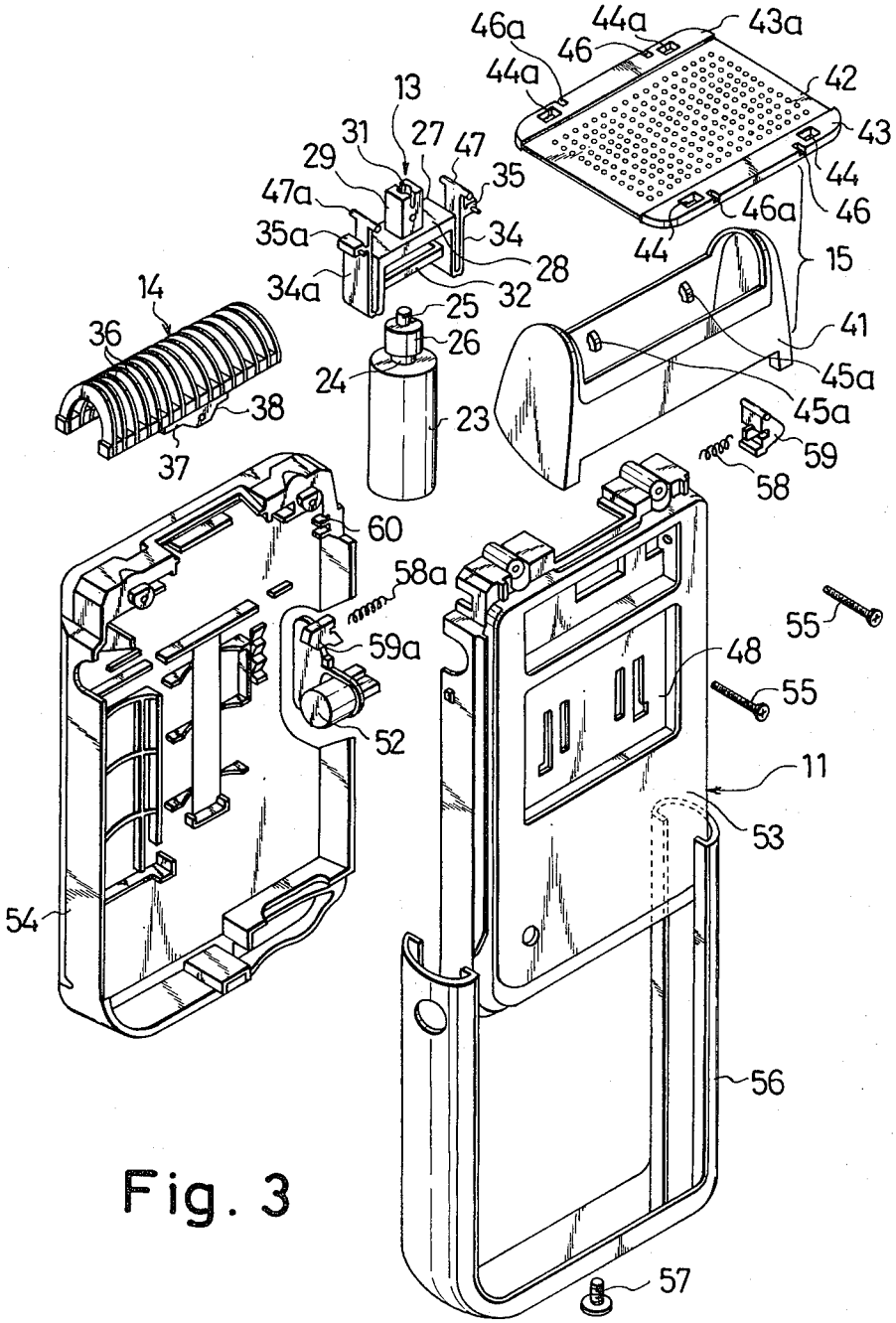
FIG. 3 is a perspective view as disassembled of main components of the shaver of FIG. 1.
Figure 4:
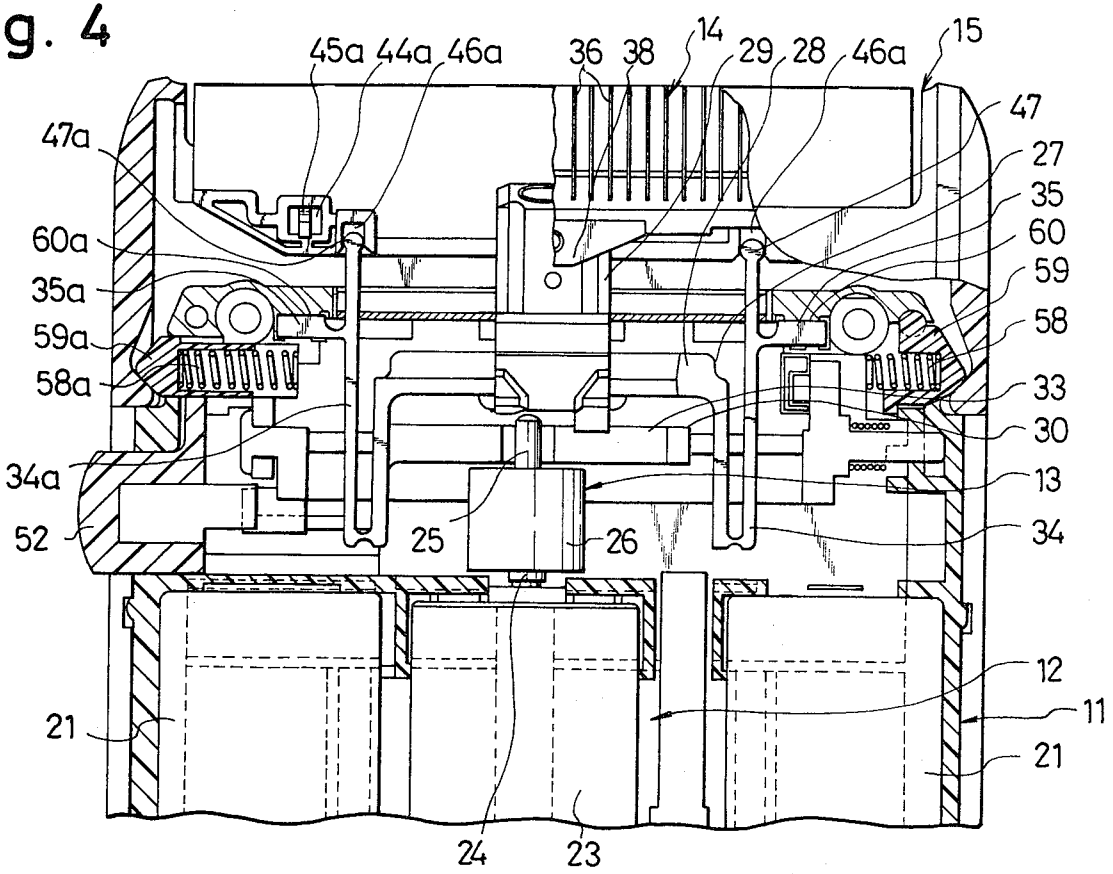
FIG. 4 is a fragmentary sectioned view as magnified for showing details of the head part of the shaver shown in FIG. 1.

According to the most remarkable feature of the present invention, both of the inner blade assembly 14 and outer blade assembly 15 are operated simultaneously and respectively at a mechanical phase reverse to each other by means of the integrally formed driver 27 of the transmitting mechanism 13, details of which arrangement shall be referred to by references in particular to FIGS. 3 and 5. The driver 27 is provided with an inverted U-shaped main driving part 28, which forms one of the two-driver elements. A connecting projection 29 is provided to project from the upper surface of a horizontal web portion 28*a* of the main driving part 28. An operatively connecting arm 30 (FIG. 5) which is L-shaped as seen from a lateral side is extended from the lower surface of the web portion. In the connecting projection 29, an axial recess 31 opened substantially circularly on the top surface and having lateral incisions extending transversely sidewards and also opened on the top surface is formed and a through hole also transversely extending in the width direction of the horizontal web is made substantially in the middle of the connecting projection 29. On the other hand, the longer side part of the L-shaped connecting arm 30 is provided with a pair of resilient side arms 32 and 32*a* (only one of them is seen respectively in FIGS. 3 and 5) connected to the shorter side part of the L-shape and extending in parallel with each other. A resilient intermediate arm 33 positioned intermediately between the resilient side arms 32 and 32*a* and extending in parallel therewith is connected to the free ends of the side arms 32 and 32*a*. In this case, the free end part of the intermediate arm 33 positioned adjacent the shorter side part of the L-shape is so provided as to be able to be connected to the eccentric pin 25.

The inverted U-shaped main driving part 28 is coupled, at the lower ends of vertical web protions 28*b*, 28*c* extending vertically downward from the both longitudinal ends of the horizontal web portion, to respective rocking leg parts 34 and 34*a* which are forming the other one of the two driver-elements extending upward in parallel with the vertical web portions to reach a level substantially even with the top surface of the connecting projection 29. These rocking leg parts 34 and 34*a* are respectively provided with fixing lugs 35 and 35*a* projected at right angles with respect to the leg parts 34 and 34*a* out of the outside surfaces of the intermediate position between the upper and lower ends of the leg parts 34 and 34*a*. Further, the driver 27 is formed preferably thinner where the horizontal web portion of the main driving part 28 joins the respective vertical web portions. Also thinned is the juncture of these vertical webs with the rocking leg parts 34 and 34*a* and of the respective fixing lugs 35 and 35*a* with the rocking leg parts 34 and 34*a* so that the thinned regions function as hinges (see in particular FIG. 5).

The inner blade assembly 14 is formed to be substantially semicylindrical in profile, and includes many inner cutter blades 36 and an inner blade mount 37 holding these cutter blades which are separated and arranged mutually parallel to lie respectively in the direction perpendicular to their reciprocating direction. An engaging projection 38 and engaging pin 39 are provided in the middle part of the blade mount 37. The engaging projection 38 is placed to ride on the connecting projection 29 of the transmitting mechanism 13, whereupon the engaging pin 39 will be thrust into the recess 31 of the connecting projection 29 and the inner blade mount 37 can be connected to the driver 27 preferably to be slightly movable up and down with such an arrangement thereforwhich is known per se as disclosed, for example, in U.S. Pat. No. 4,038,749 or German Patent Offenlegungsschrift No. 2,601,152. Further, a push-up spring 40 is fitted within the recess 31 to provide to the inner blade mount 37 a spring load always pushing up the same.

Figure 2:
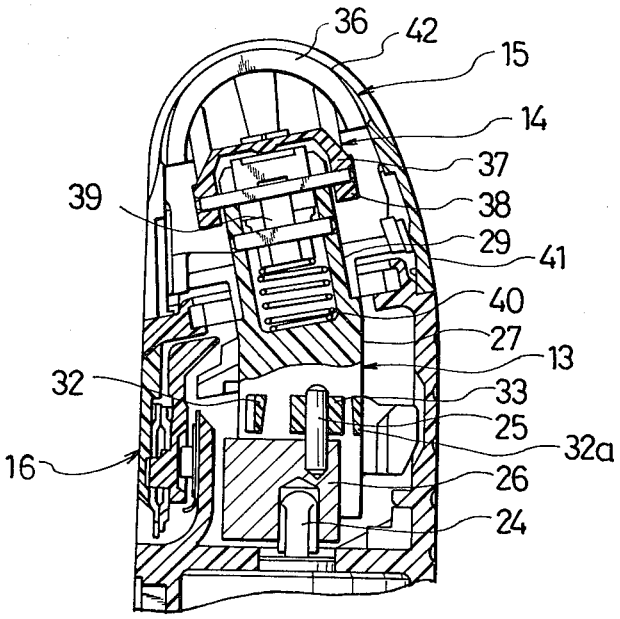
FIG. 2 is a fragmentary vertically sectioned view of the shaver of FIG. 1 taken along a central plane transversing that of FIG. 1.

The outer blade assembly 15 includes an outer blade frame 41 fitted to the top part of the casing 11. In the case where this outer blade frame 41 is formed to be fitted to the casing 11 as inclined toward one of lateral sides in the directions vertical to the reciprocating directions of the inner blade assembly as shown in FIG. 2 (which lateral side shall be referred to hereinafter as the "front" side of the casing), the connecting projection 29 may be provided to project as inclined toward the same front side as above with respect to the main driving part 28 of the driver 27. On the other hand, the outer blade 42 is held displaceably in the reciprocating direction of the inner blade mount 37 on the outer blade frame 41. That is, locking projections 45 and 45*a* provided to project inward from the inner surface of the outer blade frame 41 are engaged in slots 44 and 44*a* made in holding edge parts 43 and 43*a* of the outer blade 42 so as to allow the blade to move in the reciprocating direction of the inner blade mount 37 but not in the direction perpendicular to the particular reciprocating direction. A small clearance is left between the inside end surfaces of the vertical part of the outer blade frame 41 and the longitudinal end edges of the outer blade 42. Further, recesses 46 and 46*a* are formed to open at the lateral side edges of the outer blade adjacent the slots 44 and 44*a* so that bar-shaped parts 47 and 47*a* extending from the top part of the rocking arms 34 and 34*a* in the direction right angles with respect to the reciprocating direction of the inner blade mount 37 can be engaged at their respective tip ends in the recesses 46 and 46*a* (see in particular FIG. 6).

The switching mechanism comprises a switch plate made slidable within a recess 48 provided in the front side surface of the casing 11 as disclosed in detail also in U.S. patent application, Ser. No. 261,278. The switch plate is so provided that the same can be readily positioned when it is moved, for example, upward from the off-position to the on-position. Also as shown in detail in the same U.S. patent application, Ser. No. 261,278, filed May 6, 1981, the trimmer mechanism 16 can be made operative when rotated by about 90 degrees clockwise in FIG. 2, as in the foregoing, by operating an operating button 52 rotatably fitted on one lateral side surface with respect to the front side of the casing 11.

Further, the casing 11 comprises a front side plate 53 and rear side plate 54, both of which are combined together by means of screws 55 and are fitted in a U-shaped casing frame 56, and these plates and frame are made integral by means of a screw 57 fastened with all components enclosed in the casing 13. Engaging pieces 59 and 59*a* given spring loads by springs 58 and 58*a* are attached to both upper outer end surfaces of the casing 11 so as to be able to resiliently hold the outer blade frame 41. Holding parts 60 and 60*a* with which the fixing lugs 35 and 35*a* of the driver 27 are engaged and held are provided to project inward from both upper inner end surfaces of the casing 11.

The operation of the reciprocating type electric shaver according to the present invention shall be described in detail. Now, the switching mechanism is operated to apply the battery voltage to the motor 23, then the motor is rotated to have the eccentric pin 25 of the balancer 26 rotated to describe a circular track and the resilient intermediate arm 33 of the driver 27 is thereby cooperatively moved. At this time, the intermediate arm 33 and side arms 32 and 32*a* maintain a predetermined rigidity in their lengthwise direction but are caused to flex in the direction perpendicular to the lengthwise direction, so that the motion component of the eccentric pin 25 in the vertical direction is thereby absorbed and only another motion component in the lengthwise direction of the respective ares are made effective. This effective motion component only in the lengthwise direction is picked up through the operatively connected arm 30 by the main driving part 28 which is thus caused to be reciprocated in its lengthwise direction and the inner blade mount 37 coupled to the connecting projection 29 of the main driving part 28 is eventually reciprocated.

Responsive to the reciprocation of the main driving part 28, on the other hand, the rocking leg parts 34 and 34*a* contiguous to the vertical web portions of the driving part 28 are caused to rock also in the same direction. However, as the fixing lugs 35 and 35*a* provided intermediate between the upper and lower ends of the rocking leg parts 34 and 34*a* are fixed to the casing 11, the lugs 35 and 35*a* act as fulcra. Thus, the movement of the lower ends of the rocking leg parts 34 and 34*a* follows the reciprocating direction of the main driving part 28, but the movement of the upper ends is the direction opposite to the reciprocating direction of the main driving part 28 or inner blade mount 37. It should be understood that the displacement or rocking amplitude at the upper ends of the rocking leg parts 34 and 34*a* is determined by the distance from the setting position of the lugs 35 and 35*a* to the upper end. Particularly, as the main driving part 28 is made thin substantially at the connecting parts of the vertical webs and lugs 35 and 35*a* respectively with the rocking leg parts 34 and 34*a* so as to function as a hinge, the rocking leg parts 34 and 34*a* can be smoothly displaced at the upper and lower ends in the directions reverse to each other.

Therefore, as the bar-shaped parts 47 and 47*a* provided at the upper ends of the rocking leg parts 34 and 34*a* are engaged at their respective ends with the holding edge parts 43 and 43*a* of the outer blade 42, the latter is displaced in the direction reverse to that of the inner blade mount 37, whereby the respective inner cutter blades 36 held on the inner blade mount 37 as well as the outer blade 42 are reciprocated at mutually reverse mechanical phases in sliding contact with each other by the single driver 27. Even when the displacement of the outer blade 42 is constant, therefore, an arrangement effective to increase the relative displacement of the inner blade 37 with respect to the outer blade can be realized, whereby, in particular the rate of hair introduction through the outer blade and eventual contacting rate of the inner cutter blades with hair will increase and, therefore, the shaving efficiency can be greatly increased.

Referring to FIG. 7 showing another embodiment of the driver according to the present invention, this embodiment is different from the foregoing embodiment in respect that the rocking leg parts are branched but is the same as shown in FIGS. 1 to 6 in other formations. More specifically, reference numerals made by adding 100 respectively to those in FIG. 5 are alloted to the same members as those in FIG. 5. In rocking leg parts 134 and 134*a* of a driver 127 of this embodiment, on the other hand, reversely moving leg parts 234 and 234*a* having bar-shaped parts 147 and 147*a* formed respectively at their top are formed as branched from the main parts of the rocking leg parts 134 and 134*a*. Further in this case, the leg parts 134 and 134*a* are bent outward in the upper parts and fixing lugs 135 and 135*a* are directly provided to extend. In this, embodiment, the reversely moving leg parts 234 and 234*a* rock with portions substantially at their branching points as fulcra, the amplitudes at the upper ends of the leg parts 234 and 234*a* can be increased and, therefore, the amplitude of the outer blade can be increased. Other parts of this driver 127 are the same as in the embodiment shown in FIGS. 1 to 6. Accordingly, the respective inner cutter blades held on the inner blade mount as well as the outer blade are reciprocated in an expanded sliding contact with each other at the mechanical phases reverse to each other, with a more increased hair introduction rate achieved by the increased reciprocating amplitude of the outer blade.

While, in the respective embodiments, the driver 27 or 127 has been referred to as being formed in an integral member, it is of course possible to form the driver in two separate elements first one of which is coupled to the motor and inner blade assembly and second one of which to the first element and outer blade. For example, the main driving part 28 or 128 acting as the first element may be separated from the rocking leg parts 34, 34*a* or 134, 134*a* acting as the second element, typically at the lower ends of the vertical web portions of the first element where the same should be fixed to a stationary part in the casing, while the thus separated lower ends of the second element should be coupled to the vertical web portions preferably at a position close to the top of the web portion as held stationary at the intermediate lugs 35, 35*a* or 135, 135*a* or any other formation but acting as a fulcrum of the second element.

Further, while the inner and outer blades are disclosed to be driven through the driver 27 or 127 by the single motor 23 as the driving source, it may be possible to employ two driving sources or two balancers or the like coupled to the single driving source specifically when the driver comprises such two separate driver-elements as in the foregoing, without altering the present invention so long as the relative reciprocal displacements of the both blades at the reverse mechanical phase may be achieved by the two driver-elements.

According to the present invention, remarkable effects can be attained in such that, as has been described above, the shaving efficiency in the same operating state as in the conventional product can be greatly improved by the enlarged relative displacing between the inner and outer blades at the reverse phase, whereby the shaving action and required time therefor can be greatly reduced. Further, as the inner and outer blades can be relatively displaced at the reverse mechanical phase, a mechanical balance can be well obtained, any vibrations of the shaver can be reduced, resulting in a less noise generation, and an electric shaver having no sense of difference and easy to use can be provided. As the both inner and outer blades can be simultaneously driven with a single driving source, they can be driven perfectly at the reverse mechanical phase to each other and a useful electric shaver can be provided with a compact formation.

What is claimed as our invention is:

1. A reciprocating type electric shaver comprising:

a casing, a driving source housed in said casing for providing an eccentric rotary force, a driving element, coupling means coupling said driving source to said driving element for reciprocating the latter, said driving element including an inverted U-shaped main driving part having a horizontal web portion and vertical web portions, a connecting projection provided on said horizontal web portion, and rocking leg parts extending respectively from lower ends of said vertical web portions so as to lie parallel thereto, each rocking leg part carrying a lateral projection intermediate lower and upper ends of said rocking leg part, each projection engaging an inner surface of the casing to enable said upper ends of said rocking leg parts to reciprocate oppositely to the direction in which the horizontal web portion is reciprocated by said driving source, said coupling means arranged to convert said eccentric rotary force into reciprocal movement and transmit said reciprocal movement to said horizontal web portion through said connecting projection of said driving element, an inner blade assembly holding a plurality of inner cutter blades and engaged to said connecting projection of said driving element for being reciprocated with said horizontal web portion, and an outer blade having hair inlet perforations and movably disposed at the top of said casing, said outer blade being operably connected to said upper ends of said rocking leg parts to be reciprocated oppositely to said inner blade assembly while slidably engaging cutting edges of said inner cutter blades.

2. A shaver according to claim 1, wherein said upper ends of said rocking leg parts include lateral lugs engaging said outer blade.

3. A shaver according to claim 1, wherein said casing includes an outer blade frame mounted to the top of the casing for movably carrying said outer blade, and the outer blade having lateral portions engaging said upper ends of said rocking leg parts of said driving element to be reciprocated thereby.

4. A shaver according to claim 3, wherein said lateral portions of said rocking leg parts comprise lugs extended from the rocking leg parts at right angles thereto.

5. A shaver according to claim 1, wherein each said rocking leg part comprises a pair of branched-out parts, a first of said branched out parts extending upwardly and defining the associated said upper end, and a second of said branched-out parts being bent laterally outwardly at a location above the place of branching-out of said first and second branched-out parts, the associated said lateral projection being disposed at the end of said laterally bent part.

6. A shaver according to claim 5, wherein said casing includes an outer blade frame mounted at the top of said casing for movably carrying said outer blade, and the outer blade having lateral portions engaging said upper ends of said first branched-out parts to be reciprocated thereby.

* * * * *